US005911247A

United States Patent [19]

Waters

[11] Patent Number: 5,911,247

[45] Date of Patent: Jun. 15, 1999

[54] JACQUARD MECHANISM FOR CREATING A SHED IN A LOOM

[75] Inventor: Paul Waters, Haslingden, United Kingdom

[73] Assignee: Scapa Group PLC, Blackburn, United Kingdom

[21] Appl. No.: 08/837,348

[22] Filed: Apr. 17, 1997

[30] Foreign Application Priority Data

Apr. 26, 1996 [GB] United Kingdom ..... 9608706

[51] Int. Cl.[6] ..... D03C 3/00; D03C 3/20

[52] U.S. Cl. ..... 139/455; 139/383 AA; 139/59

[58] Field of Search ..... 139/455, 383 AA, 139/59, 65, 622

[56] References Cited

U.S. PATENT DOCUMENTS

| | | | |
|---|---|---|---|
| 3,918,500 | 11/1975 | Katsumata | 139/59 |
| 4,416,310 | 11/1983 | Sage . | |
| 4,827,986 | 5/1989 | Tanaka . | |
| 5,002,099 | 3/1991 | Seiler | 139/455 |
| 5,070,913 | 12/1991 | Palmer | 139/455 |
| 5,479,964 | 1/1996 | Burigana | 139/455 |

FOREIGN PATENT DOCUMENTS

| | | |
|---|---|---|
| 0 330 624 | 8/1989 | European Pat. Off. . |
| 711955 | 7/1954 | United Kingdom . |
| 994891 | 12/1963 | United Kingdom . |
| 1005664 | 9/1965 | United Kingdom . |
| 1215045 | 12/1970 | United Kingdom . |
| 2 221 475 | 2/1990 | United Kingdom . |

*Primary Examiner*—Andy Falik

*Attorney, Agent, or Firm*—Jacobson, Price, Holman & Stern, PLLC

[57] ABSTRACT

A Jacquard mechanism for creating a shed in a loom has a plurality of hooks operative to be connected, optionally via one or more other bodies, to yarns in a loom. The hooks are movable between a first position and a second position. A griffe is provided, the griffe being movable along a path so as to engage the hooks when the hooks are in the first position. The Jacquard mechanism also has a plurality of solenoids, each solenoid having a plunger operative to directly engage a hook. Movement of the plunger causes an associated hook to move to the second position wherein it will not be engaged by the griffe as it moves along the path.

14 Claims, 5 Drawing Sheets

JACQUARD MECHANISM FOR CREATING A SHED IN A LOOM

BACKGROUND

The present invention relates to a Jacquard mechanism.

DESCRIPTION OF THE RELATED ART

Looms which contain Jacquard mechanisms are capable of producing highly ornate woven designs. This is because the Jacquard mechanism provides for independent movement of all of the warp ends forming the upper part of the shed. In conventional Jacquard looms each warp end has its own eye. The eye is weighted with a small iron cylinder to hold it in position, but a series of harness cords runs upwards from the eyes to a perforated board (the comber board) which keeps them parallel. Each cord passes through a separate hole, and the total number of holes is that of the warp threads. When the pattern does not repeat across the fabric each cord lifts one thread, but where the pattern does repeat those warp threads which lift at the same time have their cords tied together so that the tied cords act as a single shaft.

Each cord is connected to a hooked rod fixed vertically above the loom with the lower end resting on a board (the bottom board); a guide board enables the hooks to move vertically. Under each row of hooks (and there may be 4 to 10 rows with about 50 rods per row) is a griffe, or long blade, which rises at each pick and carries with it, by the hook, all the rods except certain which have been tilted backwards.

The position of the hooks is in accordance with the following movement: each rod has a horizontal needle in contact with it and at the end of the needle is a spring to keep the hook pressed against the griffe. At the end of each pick, all the hooks press against the griffe, so that if it rose with all the hooks, then all the rods would lift and hence all the ends. However, in, front of the plane of the needle heads is situated a square prism whose shape matches that of the needle heads, and this prism makes a quarter-revolution with every pick and so presents a new face to the needle heads. On the face of the prism is a series of cards, laced together in an endless band, each card corresponding to one pick. A hole is punched in the card for every warp end in the appropriate position so that perforations only occur where the end must be removed. Hence the needles which pass through the holes remain in position and keep the hooks on the griffe, so that when the griffe rises, the corresponding cords and warp ends rise also. The imperforate portions of the card will press back the corresponding needles and tilt the rods with which they are in contact, so that the griffe misses them when it rises. The prism, as previously indicated, presents a fresh face to the needles at every pick, and so actuates different warp ends.

These Jacquard mechanisms may also be used in seaming a flat woven fabric to render it endless. During seaming weft yarns are removed from both ends of the fabric to provide a fringe of exposed warp yarns. A system of so-called auxiliary weft yarns is provided between the two fringed fabric ends with which the exposed warp yarns are interwoven to form an endless fabric. The Jacquard mechanism controls the shedding of the auxiliary weft yarns; that is it lifts these yarns in a selected pattern at the same time as mirror image rapiers pass the exposed warp ends into the seam region. Thus a weave pattern is obtained.

As mentioned above, cards are used to co-ordinate the movement of the hooks which in turn co-operate with harness cords that lift the yarns so as to provide the shed.

The main problem with these cards is that they are costly to make, time consuming to install and remove and require a considerable storage space. The vast number of potential weave patterns further requires a correspondingly large number of cards. Thus a considerable storage space is required for the cards.

U.S. Pat. No. 3,918,500 describes a solenoid operated Jacquard mechanism in which each horizontal needle for moving the hooks is operated by a separate solenoid. The solenoids are selectively engaged by a control unit which in turn is controlled in response to the pattern information read out from, perforated or magnetic tapes The needles, except those attached and held by the engaged solenoids are engaged by the blade.

SUMMARY OF THE INVENTION

The problem with this arrangement is that it remains relatively complicated. The present invention seeks to provide a more simple arrangement which is consequently more reliable.

According to a first aspect of the present invention there is provided a Jacquard mechanism for creating a shed in a loom, wherein the Jacquard mechanism comprises the following elements:

- plurality of hooks operative to be connected, optionally via one or more other bodies, to yarns in a loom, the hooks being movable between a first position and a second position;
- a griffe, the griffe being movable along a path so as to engage the hooks wherein the hooks are in the first position,
- a plurality of solenoids each solenoid having a plunger operable to directly engage a hook;
- wherein movement of the plunger causes an associated hook to move to the second position wherein it will not be engaged by the griffe as it moves along the said path.

By arranging for the solenoid plunger to directly engage the hook, the transversely orientated needles associated with known Jacquard mechanisms are eliminated. Thus the Jacquard mechanisms of the invention should be more reliable. Furthermore machine wear is reduced by arranging the apparatus in this fashion.

In a preferred embodiment of the invention each solenoid may be energised individually. The solenoids are ideally mounted on a circuit board. The solenoids are thus preferably connected to a circuit board which in turn is connected to a controller card or more preferably to a computer. Computer software allows data to be passed to each solenoid via the controller card, either as fixed patterns; i.e. all on or all off, or as a read pattern. New software relating to new weave patterns can be installed in a matter of seconds.

The hooks are preferably made of a non-magnetic material, such as non-magnetic steel. This prevents interference between the magnetism generated in the solenoids and the hooks. The solenoid plunger preferably fires upwardly.

A plunger stop is preferably provided at the end of the solenoid which is remote from the hook guide. This plunger stop is ideally cushioned.

Software may be provided for detecting faulty solenoids.

The hooks are usually connected to harness cords which in turn are connected to healds. A single yarn is connected to each heald.

The invention has particular, but not exclusive, application in a seaming machine for papermaking fabrics.

According to a second aspect of the present invention there is provided a seaming machine for seaming the ends of papermaking fabrics, said seaming machine comprising a Jacquard mechanism of the type hereinbefore described.

The present invention further seeks to provide a sensing system to confirm that all of the hooks have been correctly selected by the appropriate solenoid pattern.

According to a third aspect of the present invention there is provided a Jacquard mechanism for creating a shed in a loom, wherein the mechanism comprises a device for selectively moving individual yarns in the loom, wherein a flag is attached to at least part of said means, an opto sensor being provided, the opto sensor being operative to detect movement of the flag.

The means for moving each yarn usually comprises a hook, harness cord and heald connected in series. The flag would usually be connected to the harness cord. Preferably each harness cord is provided with a flag.

In each selection cycle the computer will compare the data received from the sensors with the data sent to each solenoid. If the solenoid has been fired then the corresponding hook has been selected and will pull the harness cord, thereby moving the flag through the sensor. A failed solenoid means that the flag does not move and the computer will stop the machine. This improves the quality and reliability of the seaming.

BRIEF DESCRIPTION OF THE DRAWINGS

In order that the present invention may be more readily understood a specific embodiment thereof will now be described by way of example only with reference to the accompanying drawings in which.

DETAILS OF THE PREFERRED EMBODIMENT

Figure 1:
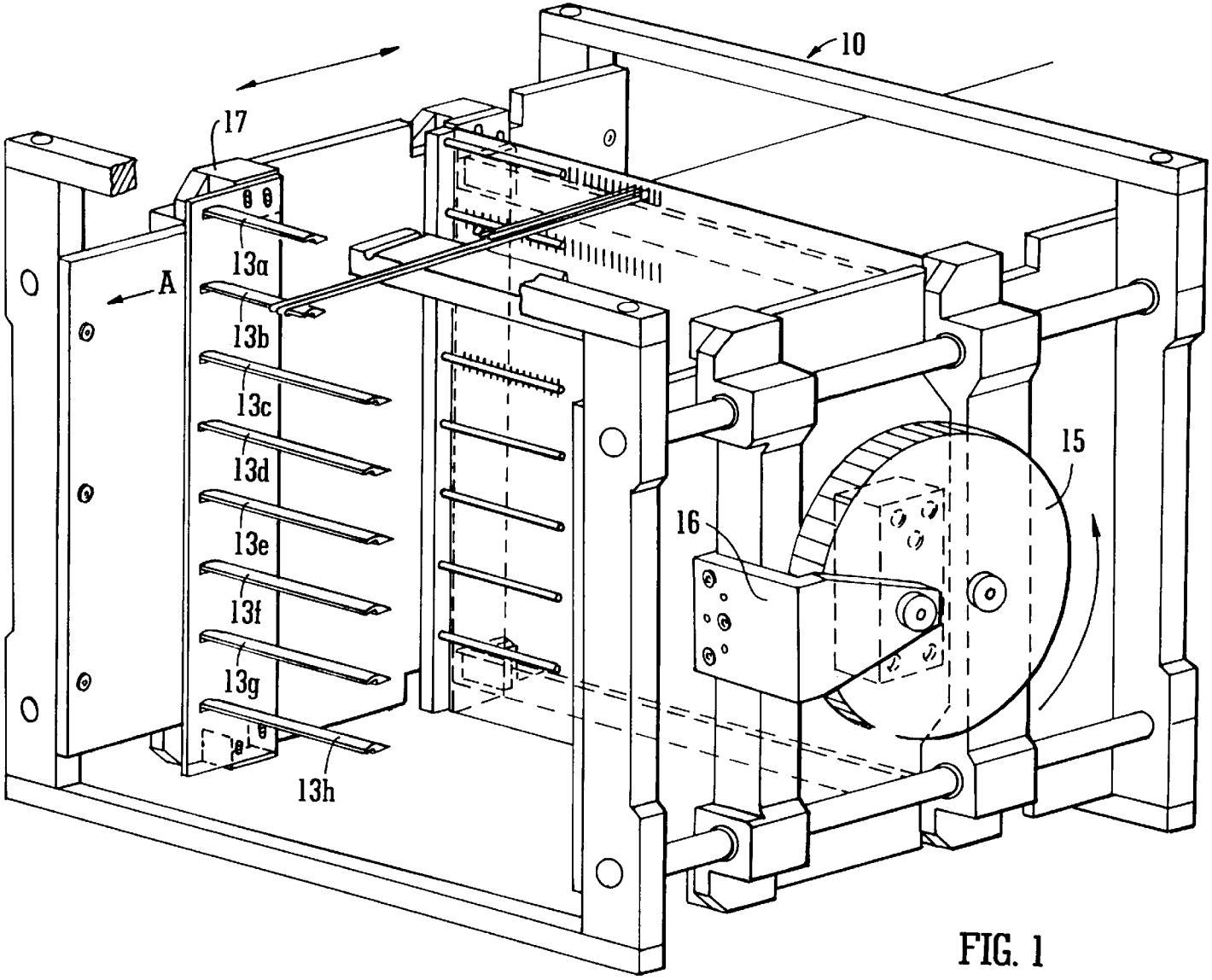
FIG. 1 is a perspective view of one Jacquard mechanism in accordance with the present invention, part of the drawing having been cut away for clarity.
Figure 2:
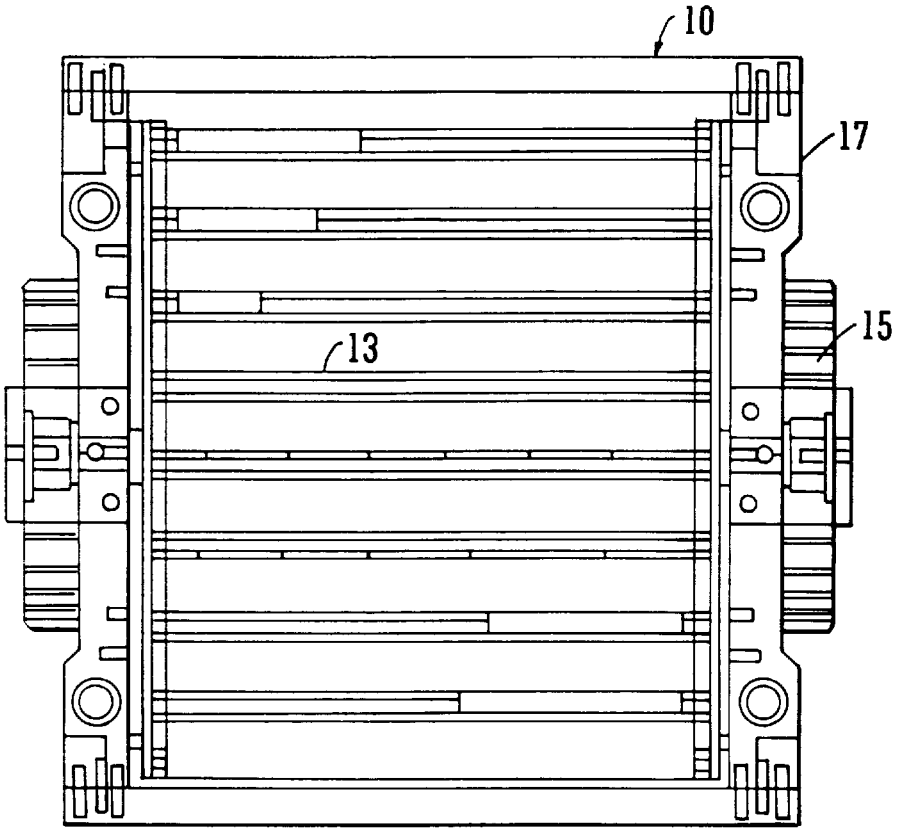
FIG. 2 is an end elevation of the mechanism of FIG. 1.
Figure 3:
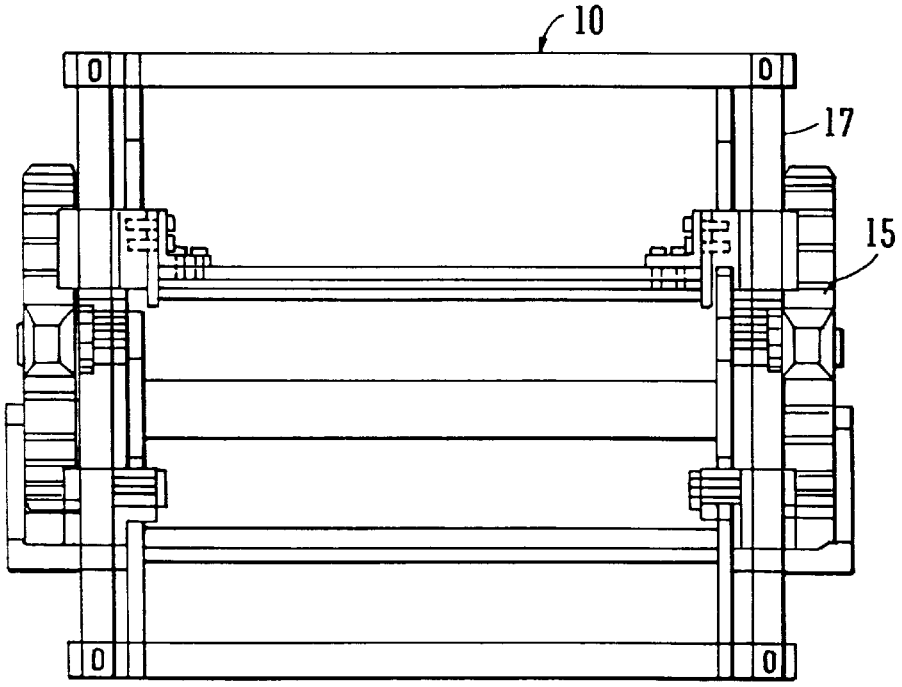
FIG. 3 is a plan view of the mechanism of FIGS. 1 and 2.
Figure 4:
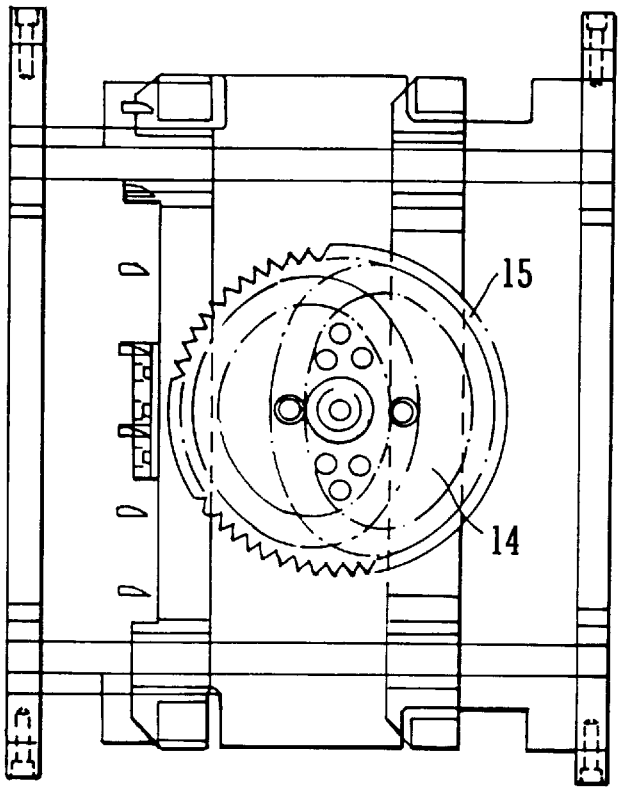
FIG. 4 is a side elevation of the mechanism of FIGS. 1 to 3.
Figure 6:
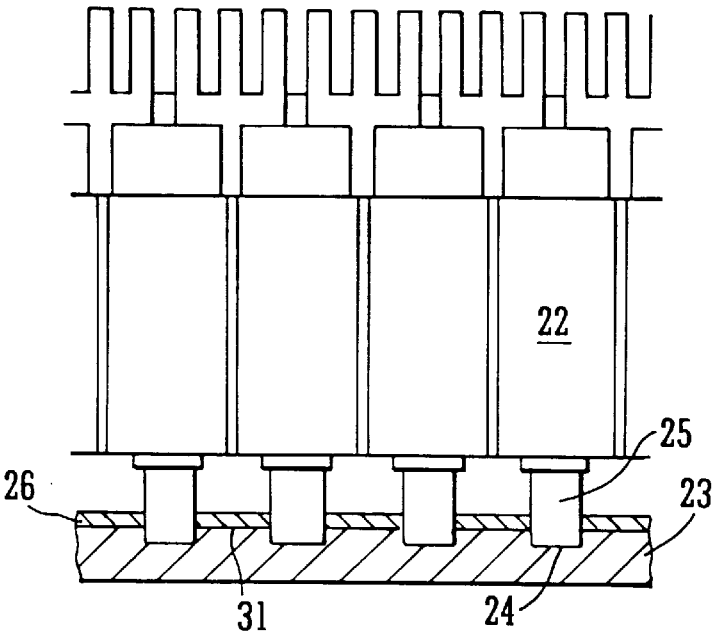
FIG. 6 shows the solenoids in position below the hook guides.
Figure 5A:
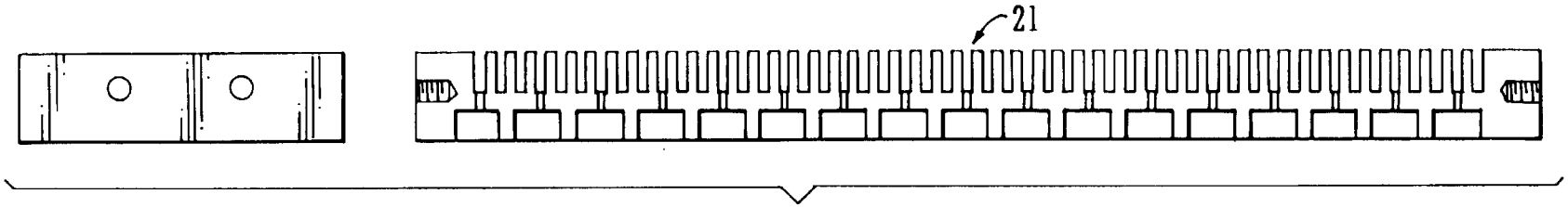
FIG. 5(*a*) and 5(*b*) show end elevation of the hook guides and a plan view of the solenoids for moving the hooks.
Figure 5B:
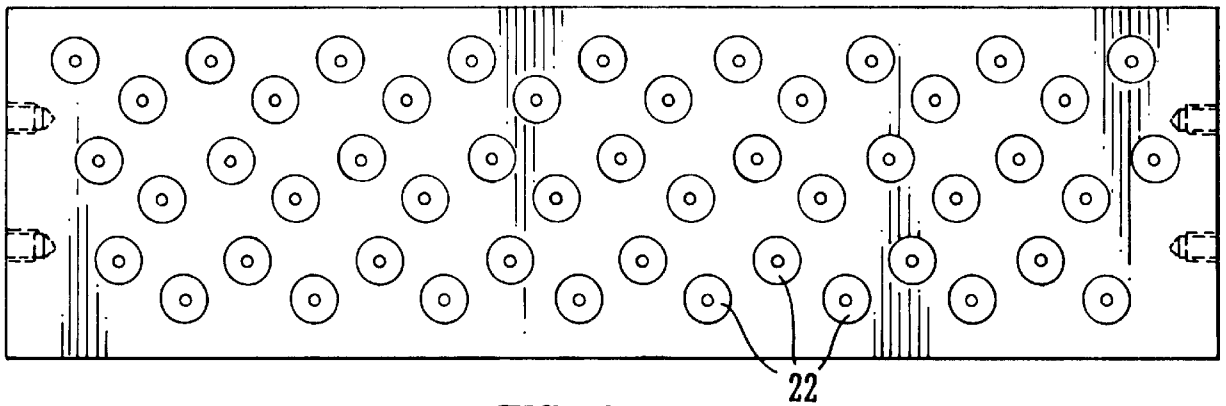

Referring to the drawings a Jacquard mechanism 10 is used to create a shed of warp yarns during weaving. A plurality of warp yarns (not shown) are each connected to a separate heald. Each heald is connected to an individual cord 11 which in turn is connected to an individual hook 12. The plurality of hooks 12 may be moved laterally in the direction of arrow "A" by a griffe bar 13. Up to one hundred hooks 12 may be captured by the griffe bar 13. Eight griffe bars 13*a* to 13*h* are provided in a stack, each griffe bar being operable to capture up to one hundred hooks. Thus up to eight hundred warp yarns may form the shed at any one time.

All of the griffe bars 13 move in unison in the direction of arrow "A" and back again under the action of a track 14 or a cam 15 which causes forward and backwards movement of a block which in turn acts on a support 17 for the stack of griffe rods 13. A cam 15 for moving the griffe bars 13 is provided on each side of the machine.

A further track is provided on each cam for causing similar movement in the opposite direction of the so called bottom plate which acts on warp yarns to form the bottom of the shed in conventional fashion.

The primary purpose of the Jacquard is to select the warp yarns which are to form the shed.

In the illustrated embodiment the hooks 12 are normally orientated horizontally. When oriented horizontally the hooked ends 19 of the hooks are captured by the griffe bar 13 as it moves laterally in the direction of arrow "A". Thus the hooks are moved by a griffe in the direction of arrow "A". Thus movement of the hooks pulls the corresponding cord, heald and warp yarn so as to cause the warp yarn to form the top of the shed, the bottom of the shed being formed in conventional fashion by the action of the bottom plate.

The shaft 20 of each hook 12 passes through one of a plurality of channels in a hook guide block 21. The hook guide block is located above a bank of solenoids 22, one solenoid being provided for each hook. The solenoids are arranged vertically above a plate 23. A series of recesses 24 are provided in the plate for the ends of the solenoid plungers 25. A circuit board 26 is secured to the plate. A plurality of apertures 31 are provided in the circuit board 26, the apertures 31 being in register with the recesses 24.

Figure 7:
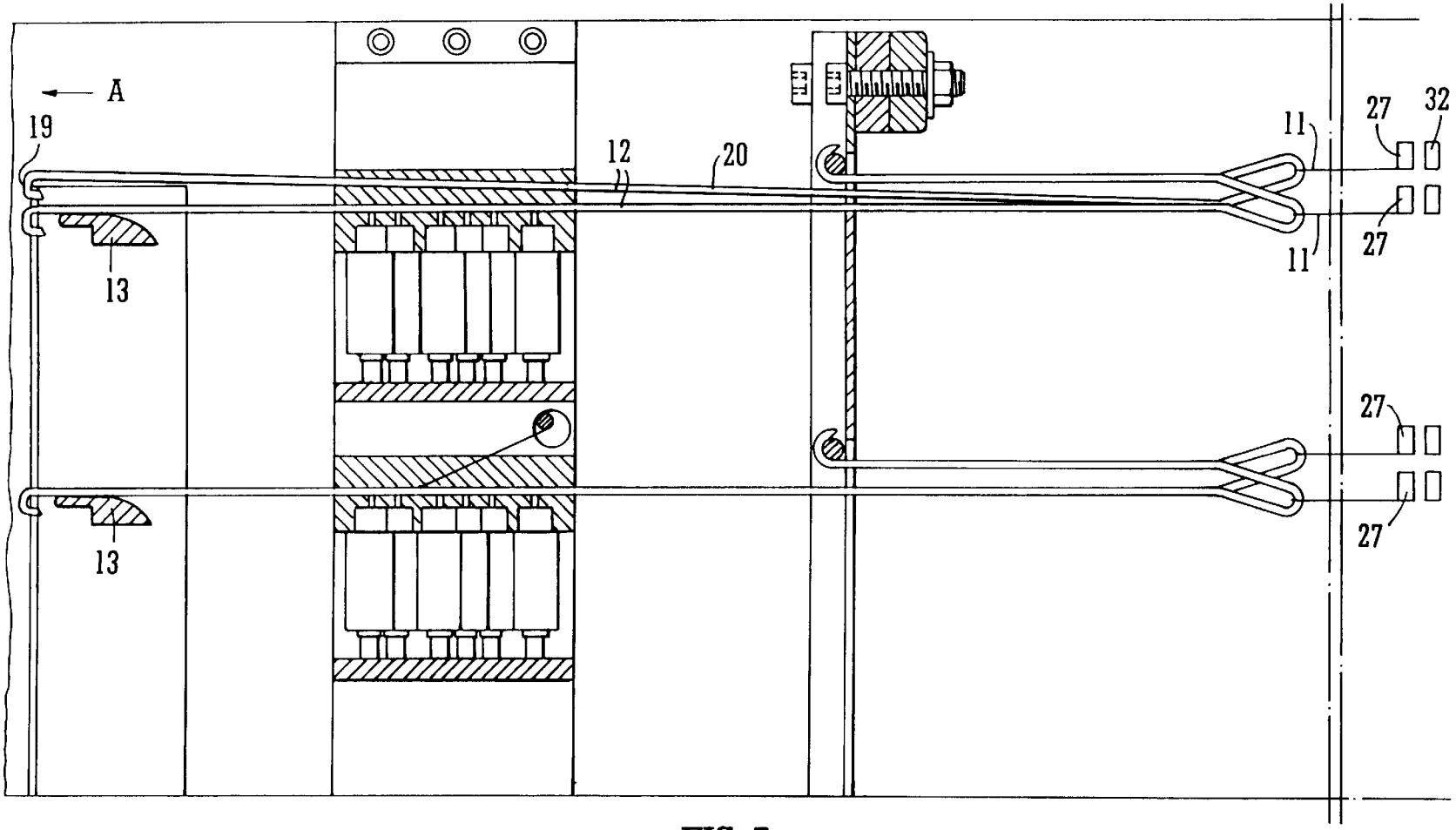
FIG. 7 shows the operation of the hooks by the solenoids.

In order to prevent a hook 12 from being captured by the griffe 13 it is necessary to lift the hook 12 as shown in FIG. 7. This is achieved by energising the appropriate solenoid 22 via the circuit board 26. This causes the solenoid plunger 25 to move upwardly and thus lift the corresponding hook 12 within the confines of the hook guide block 21. While the hook 12 is lifted the griffe bar 13 moves in the direction of arrow "A". Only the hooks 12 which are not associated with energised solenoids 22 will form the shed. When no longer energised the plunger descends once again allowing the hook 12 to drop under gravity to its original position.

The solenoids are selectively energised in response to an output signal emitted from a control unit, such as a computer, in accordance with the desired fabric pattern. Each weave pattern is recorded on computer software.

A flag 27 is connected to each cord 11 which is secured to a hook 11 when the hook 12 is moved by the griffe 13 the cord 11 moves thereby moving the flag 27. This movement is detected by an opto sensor 32. A failed solenoid means that the flag 27 does not move and the control unit detects the fault and stops the machine.

It is to be understood that the above described embodiment is by way of illustration only. Many modifications and variations are possible.

For example if the hooks are not arranged horizontally then it may be necessary to capture the hooks in the guide block, possibly by way of some resilient means, such as a leaf spring.

I claim:

1. A Jacquard mechanism for creating a shed in a loom which comprises:

a plurality of hooks operative to be connected to yarns in a loom and movable between a first position and a second position by a plurality of solenoids;

a griffe and a mechanism for moving said griffe along a path so as to engage the hooks when the hooks are in said first position;

each solenoid having a plunger operative to directly engage one of said hooks and to move the said one hook between first position and said second position; and a sensing system to confirm that all of the hooks have correctly selected by an appropriate solenoid pattern;

wherein movement of the plunger causes an associated hook to move to the second position where the hook will not be engaged by the griffe as it moves along said path.

2. A Jacquard mechanism as claimed in claim 1, each of said solenoids individually engaging a respective hook.

3. A Jacquard mechanism as claimed in claim 1, wherein the hooks are made of a non-magnetic material.

4. A Jacquard mechanism as claimed in claim 1, wherein means are provided for detecting faulty solenoids.

5. A Jacquard mechanism as claimed in claim 1, wherein the sensing system comprises an opto sensor.

6. A Jacquard mechanism for creating a shed in a loom which comprises a device for selectively moving individual yarns in the loom, wherein a flag is attached to at least part of said device, said device further including an opto sensor to detect movement of the flag, and the device for moving each yarn comprising one of a plurality of hooks, a harness cord and a heald connected in series.

7. A Jacquard mechanism as claimed in claim 7, wherein the flag is connected to the harness cord.

8. A Jacquard mechanism as claimed in claim 7, wherein each harness cord is provided with a flag.

9. A Jacquard mechanism for creating a shed in a loom which comprises:

a plurality of horizontally positioned hooks operative to be connected to yarns in a loom and biased under force of gravity to a first position;

a griffe;

a mechanism for vertically moving said griffe along a path, the griffe engaging the hooks when the hooks are in the first position; and a plurality of solenoids each solenoid having a plunger to cause an associated hook to move between the first position and a second position where the hook will not be engaged by the griffe as it moves along said path.

10. A Jacquard mechanism as claimed in claim 9, each of said solenoids individually engaging a respective hook.

11. A Jacquard mechanism as claimed in claim 9, wherein the hooks are made of a non-magnetic material.

12. A Jacquard mechanism as claimed in claim 9, wherein means are provided for detecting faulty solenoids.

13. A Jacquard mechanism as claimed in claim 9, wherein the mechanism comprises a sensing system to confirm that all of the hooks have been correctly selected by an appropriate solenoid pattern.

14. A Jacquard mechanism as claimed in claim 9, wherein the sensing system comprises an opto sensor.

* * * * *